US005845629A

United States Patent [19]

Ratliff

[11] Patent Number: 5,845,629

[45] Date of Patent: Dec. 8, 1998

[54] HOOK AND LOOP AIR GUN AND METHOD THEREFOR

[75] Inventor: Michael Carson Ratliff, Phoenix, Ariz.

[73] Assignee: Ratpak, Inc., Phoenix, Ariz.

[21] Appl. No.: 823,969

[22] Filed: Mar. 25, 1997

[51] Int. Cl.[6] ..... F41B 11/00

[52] U.S. Cl. ..... 124/56; 273/DIG. 30; 473/573

[58] Field of Search ..... 124/48, 51.1, 56, 124/58, 59, 66, 67, 72; 273/DIG. 30; 473/573

[56] References Cited

U.S. PATENT DOCUMENTS

| | | | |
|---|---|---|---|
| 2,003,290 | 6/1935 | Gurney | 42/105 |
| 3,032,345 | 5/1962 | Lemelson | 273/348.4 |
| 3,233,353 | 2/1966 | Lahr | 42/54 |
| 3,857,566 | 12/1974 | Lemelson | 273/348.4 |
| 3,917,271 | 11/1975 | Lemelson et al. | 273/DIG. 30 X |
| 4,054,120 | 10/1977 | Foley | 124/62 |
| 4,422,433 | 12/1983 | Milliman | 124/48 X |
| 4,656,092 | 4/1987 | Haman | 428/402.2 |
| 4,875,689 | 10/1989 | Lin | 473/573 |
| 4,986,251 | 1/1991 | Lilley | 124/48 X |
| 5,139,273 | 8/1992 | Rudell et al. | 473/573 X |
| 5,344,155 | 9/1994 | Huang | 473/573 X |

OTHER PUBLICATIONS

Toys and Novelties, Aug. 1962, p. 128 (Advertisement).

*Primary Examiner*—John A. Ricci
*Attorney, Agent, or Firm*—Harry M. Weiss; Jeffrey D. Moy; Harry M. Weiss & Associates, P.C.

[57] ABSTRACT

A gun and target system and method is disclosed wherein a hook-and-loop ball is fired through an air or gas gun at a hook-and-loop target.

14 Claims, 2 Drawing Sheets

HOOK AND LOOP AIR GUN AND METHOD THEREFOR

FIELD OF THE INVENTION

This invention relates to compressed air or gas powered guns, wherein a projectile covered with hook or loop material is propelled towards a target covered with the reverse form of hook or loop material, and method therefor.

BACKGROUND OF THE INVENTION

There are a number of non-lethal recreational or training weapons on the market today. These include air or gas-powered guns that fire "paintballs," plastic covered balls of paint, and air or gas-powered guns that fire round, BB-type metal projectiles. Paintball guns are typically used in military-type games, in which the participants wear protective clothing and attempt to shoot each other with paintballs. The mark left from a splattered paintball indicates whether or not there has been a hit.

There are a number of drawbacks with paintball-type games as played with current equipment. After a number of impacts on a player's clothing, it can be difficult to determine if a paint stain represents a new hit or an old one, and mid-game clothing changes can be necessary. Additionally, the plastic cover of the paint ball can, upon breaking, reveal sharp edges that can harm exposed skin during impact. Also, the splattering paint of an exploding paintball makes this equipment inappropriate for use in a home or office setting.

BB-type guns fire small metal projectiles—generally 0.177 or 0.22 caliber—that are not generally considered lethal. However, these projectiles can be substantially harmful if they strike a person, and are certainly capable of breaking through human skin and of damaging a human eye. Like paintballs, these projectiles can generally not be safely fired in a home or office setting.

Of course, firearms firing bullets—as opposed to paintballs or BB-type projectiles—cannot safely be fired in a home or office setting. Thus, for example, a person who wishes to practice shooting a real firearm must generally travel to an indoor or outdoor gun range for such activity.

Therefore, a need existed for an improved projectile that can be fired from an air or gas-powered gun of the types commonly used to fire BB-type projectiles or paintballs. The improved projectile must be capable of being used with existing air or gas-powered guns, with little or no modification to the gun. The improved projectile must also be capable of being used in a paintball-type military game, and thus must not be unduly dangerous and must be capable of registering contact in some fashion. The improved projectile must also be suitable for use for indoor practice shooting, in a home or office setting, with a target of suitable material to be used with such a projectile.

SUMMARY OF THE INVENTION

A combination gun and projectile that is safe and which overcomes the disadvantages of the prior art is disclosed. The system and method is embodied in a combination of hook-and-loop ball projectiles and means for holding the projectile with a circumferential peripheral portion in compression. The projectiles are aligned with a barrel through which the projectile can pass only by being circumferentially compressed in the barrel. Upon application of air or gas pressure from suitable means for applying propulsion air or gas to the projectile, the projectile is accelerated as it passes through the barrel and shot at a target, which target comprises hook or loop material complimentary to that on the projectile. In a preferred form of the invention, a magazine so constructed and configured as to define the cylindrical holding means is used to hold a plurality of such projectiles, and to feed such projectiles into an air or gas-type gun.

DESCRIPTION OF THE PREFERRED EMBODIMENTS

Figure 1:
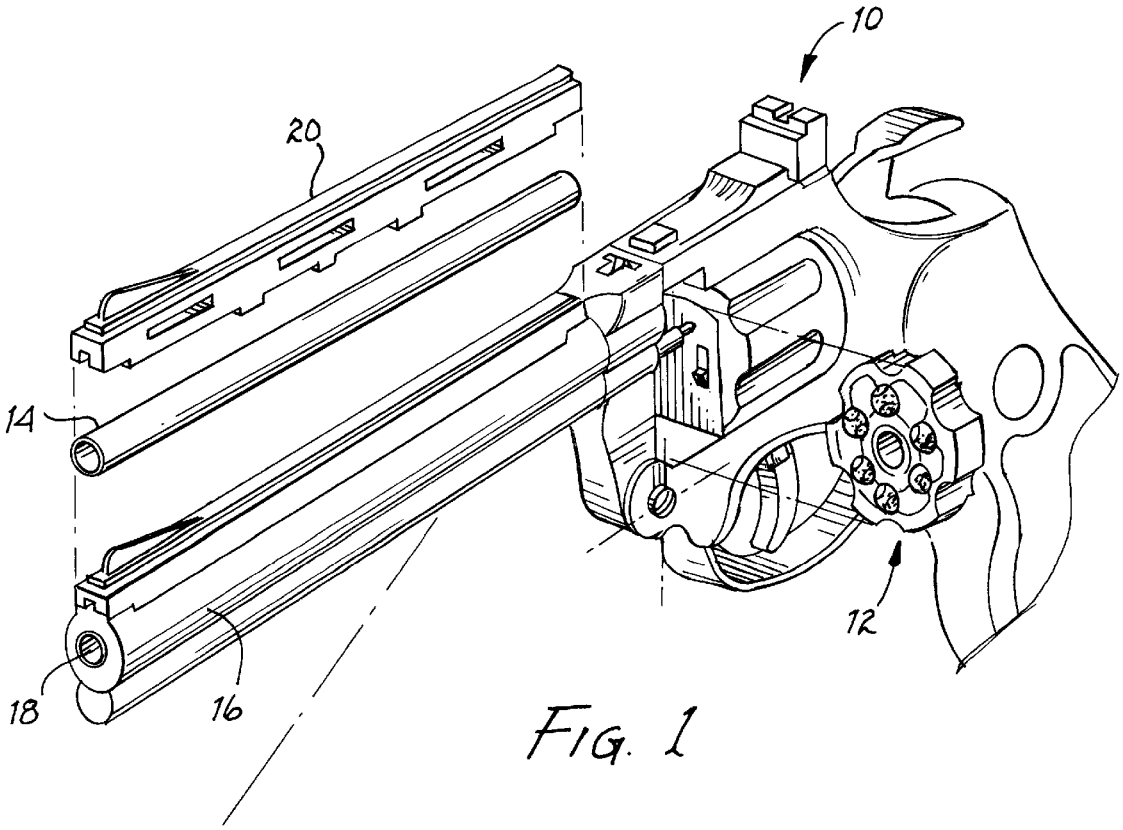
FIG. 1 is an exploded view of a commercial air pistol modified in accordance with this invention for propelling hook-and-loop ball projectiles by compressed gas.

Reference is made first to FIGS. 1 through 6, specific reference being made first to FIG. 1. FIG. 1 depicts a very widely sold compressed gas propulsion gun 10 that has been rebuilt and modified in accordance with the invention disclosed and claimed herein. The original commercial gun was the popular CROSSMAN@ carbon dioxide gun built to the general size and appearance of the famous 0.357 MAGNUM®. Since millions of these guns have been sold and the structure and functions thereof are so well-known, it would be inappropriate to enter into a detailed description of the commercial gun. In the interest of completeness of disclosure, however, a general description is provided.

The CROSSMAN® air gun receives a standard carbon dioxide cartridge in the handle, filled with cooled carbon dioxide, one of the grips being removable to permit the cartridge to be inserted after a spent cartridge is removed. A screw operated clamp forces the nozzle of the cartridge over a sharp hollow cylinder which opens the cartridge and against a seal to prevent loss of the gas in the cartridge. A gas conduit passes the carbon dioxide into a chamber inside what appears to be a standard revolver magazine but which is integral with the frame of the gun. The CROSSMAN magazine is a circular disk-like structure in which a set of radially disposed recesses receive a plurality of conventional BB-type projectiles. A passage through the magazine applies the carbon dioxide pressure from the cartridge through the gas conduit to the pellet when the gun is fired. The magazine fits on a spindle on the barrel assembly, which pivots down to receive the magazine. The barrel assembly is pivoted up, to the position shown in FIG. 1, and locked in place by a spring biased clip. Tapered bosses on the back side of the magazine interact with an actuator operated by the trigger and/or the hammer to rotate the magazine and, thereby, position the pellet in alignment with the barrel. When the user "fires" the gun, he pulls the trigger which operates the actuator to assure positioning of the pellet and applies for an instant the pressure of the carbon dioxide in the cylinder through the passage to the pellet. The pellet is propelled by the pressure through and out the distal end of the barrel.

Generally, air guns 10 of the type shown in FIG. 1 fire a projectile (not shown) having a caliber of 0.177 or 0.22, propelled by compressed, cold air or gas from a cartridge (not shown) in the handle of the gun. Referring again with particularity to FIG. 1, the air gun 10 uses a magazine 12 to hold individual projectiles (not shown) in position, which magazine 12 rotates as each projectile is fired. When fired, the projectiles pass through a projection tube 14, which is displaced within a barrel 16, and out the projection tube opening 18. Fitting over the projection tube 14 is a closure 20, which is largely ornamental and is used for aiming purposes.

Figure 2:
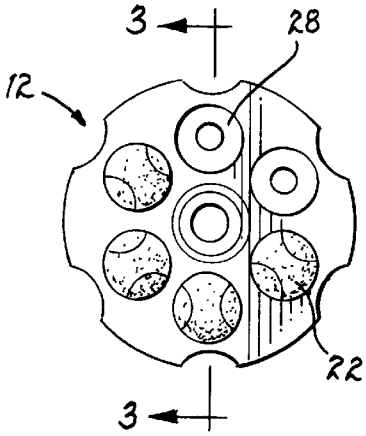
FIG. 2 is a front plan view of the circular cartridge magazine of the pistol of FIG. 1 holding a number of hook-and-loop ball projectiles.
Figure 3:
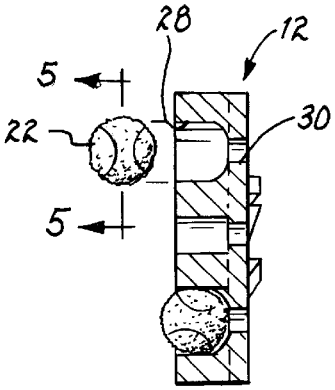
FIG. 3 is a side view in cross-section showing the magazine of FIG. 2 with one hook-and-loop ball projectile in place and one hook-and-loop ball projectile being propelled from the magazine.
Figure 5:
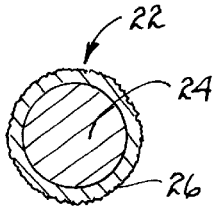
FIG. 5 is a cross-sectional view of the diameter of one of the hook-and-loop ball projectiles.

Referring now to FIGS. 1–3, the magazine 12 of the gun 10 is shown loaded with hook or loop projectiles 22 of the present invention. The projectiles 22, as shown in FIGS. 2, 3 and 5, are spherical, and can be made in essentially any desired caliber. A center sphere 24, preferably made of rubber or plastic but also possibly comprising air for certain applications, is covered with either hook material or loop material 26 preferably in the same manner as the core of a baseball or tennis ball is covered, i.e. with two mating pieces that, when sewn or otherwise bonded together define a sphere. This method of construction is, of course, well-known. The colors of the two mating pieces that comprise the hook or loop material 26 can be varied as desired, using any combination of colors possible. The two mating pieces that comprise the hook or loop material 26 are preferably glued to the center sphere 24, or formed around the center sphere 24 in essentially the same manner as a tennis ball in the event that the center sphere 24 comprises air. In general, it appears preferable to use the loop type of material on the projectile 22 and the hook type of material for the target 40 (See FIG. 6), although the reverse configuration is also possible.

Figure 4:
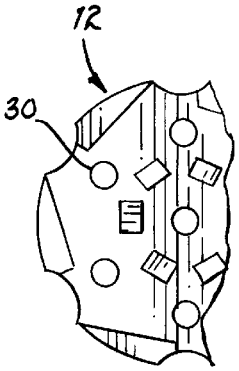
FIG. 4 is a partial view of the back side of the magazine of FIG. 2 showing passages through which the propellant gas is applied to the hook-and-loop ball projectile.

Referring now to FIGS. 2, 3 and 4, it will be seen that the magazine 12 has been configured and constructed to define a plurality of hook or loop projectile compressing and holding recesses, an exemplary one of which is shown at 28. Such an exemplary projectile 22 is shown in compression in the recess 28 in FIGS. 2 and 3, and one of the projectiles is being projected in FIG. 3. The hook-and-loop ball projectile is projected through the projection tube 14 and out the projection tube opening 18 at the distal end of the gun 10. FIG. 4 shows the proximal end of the passage 30 through the magazine 12 through which the carbon dioxide is applied to the compressed hook-and-loop ball projectile 22 in the recess 28.

The gun 10 of FIG. 1 can be used, without modification, with a projectile 22 of the present invention provided that the projectile 22 is of the same caliber as the gun 10. If the projectile 22 is of a larger caliber—for example a 0.38 or 0.357 caliber—than the relatively standard 0.177 or 0.22 caliber air gun, the air gun 10 can be readily modified to accommodate the projectile 22. This is accomplished by substituting a projection tube 14 of the unmodified gun 10 with one having a caliber appropriate to that of the projectile 22. Further, the magazine 12 is either replaced with one having recesses 28 dimensioned to receive the larger projectile 22, or by modifying the original magazine 12 so as to increase the diameter of the recesses 28. Such modification can be accomplished, for example, by drilling out the original magazine 12, and then replacing the drilled out portion with material, such as JB Weld, in such manner so as to define recesses 28 of the appropriate diameter.

Figure 6:
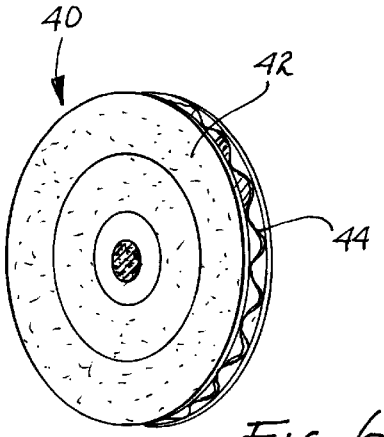
FIG. 6 is a perspective view of a target for receiving the hook-and-loop ball projectiles.

The hook-and-loop ball projectile 22 may be fired toward a target 40, of the type shown in FIG. 6. The shape of the target 40 is not critical to this invention, and virtually any shape is possible. The target 40 comprises a front face 42 of either hook or loop type material, opposite to the hook or loop material covering the projectile 22 (e.g., if the projectile 22 is covered with loop material, then the front face 42 should be of hook material). In order to assure optimal adhesion of a projectile 22 to the front face 42 of the target 40, the target 40 preferably comprises a layer of resilient material 44 (constructed from foam rubber or any other material having similar resiliency) underlying the front face 42 that gives easily and can be easily deformed to enwrap to some degree the projectile 22—and that should prevent the projectile 22 from bouncing off of the target 40. The target 40 can be mounted on any stationary object, such as a wall or door, used as a moving target, and can also be worn over the clothing (or be incorporated into the clothing) of a person playing a paint-ball type game with a gun 10 and projectile 22 of the present invention.

Figure 7:
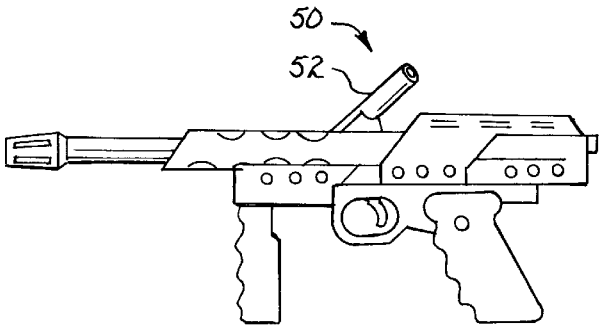
FIG. 7 is a side view of an unmodified, prior art paintball-type gun.

Referring now to FIG. 7, a standard paintball-type gun 50 is shown. The gun 50 includes a feed tube 52 into which paintballs are fed into the gun 50. Generally, a paintball gun 50 will fire a paintball (not shown) having a caliber of 0.68 or 0.62, although other calibers have been used in the past and it is of course possible that other calibers will be introduced in the future. As with the air gun 10 shown in FIG. 1, the paintball-type gun 50 utilizes a cartridge of compressed, cold gas to propel the projectile 22. The projectile 22 of the present invention, together with the target 40 of the present invention, can be used without modifying the gun 50 provided that the caliber of the projectile 22 corresponds to that of the gun 50. In this manner, the gun 50 can be used to fire the projectiles 22 at the target 40, which target 40 can be adhered to a stationary target or which can be worn by a person for use in a paintball-style military game.

The projectile 22 of the present invention can be used with essentially any configuration of BB-type or paintball-type compressed air-type gun, and is not limited to the exemplary configurations shown in FIG. 1 or FIG. 7. The only requirement in each instance is that the projectile 22 have a caliber that is compatible with the particular air gun or, if not, that the barrel of the air gun and, if necessary, the magazine or other feeding structure, be replaced or altered along the lines described above to accommodate a different caliber projectile 22.

Figure 8:
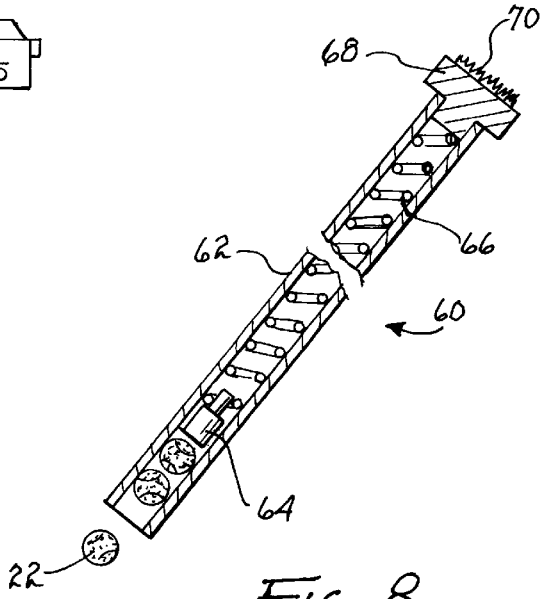
FIG. 8 is a magazine for loading hook-and-loop ball projectile into the gun shown in FIG. 7.

The magazine 60 shown in FIG. 8 holds a number of hook-and-loop ball projectiles 22 in a cylinder 62. The projectiles 22 are biased toward the barrel by a plunger 64 and spring 66 held in place by a cap 68. When one projectile 22 is fired, another moves under the plunger 64 into the barrel. The magazine 60 is dimensioned to be inserted into the feed tube 52 of the paintball gun 50. Optionally, the magazine 60 may be held into position by use of a hook and loop strap (not shown), which secures a hook or loop patch 70 on the cap 68 to the body of the gun 50.

It will now be seen that the system of this invention can be safely used in paintball-type games, in target practice, for recreation, for gun training, or for virtually any other use for which a non-lethal weapon is suitable. Since the projectiles can be removed from a target worn by paintball game participants, the confusion and disagreements inherent in the use of paintballs is avoided. In a paintball game application, instead of wearing a target 40, the participants can wear any of several soft weave materials, e.g. terry cloth, which serves very effectively as target material of the loop type. For target practice and gun training purposes, the system of this invention can be used safely in a home or office setting.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A combination gun, projectile therefor, and target comprising in combination:

at least one of a compressed air gun and a compressed gas gun having a barrel;

at least one spherical projectile located in said gun and having an entire exterior surface comprising at least one of hook material and loop material;

said barrel being dimensioned to receive each of said at least one spherical projectile;

means located in a barrel of said gun for holding a circumferential peripheral portion of said spherical projectile in compression;

means for aligning said spherical projectile with said barrel through which said spherical projectile can pass only by being circumferentially compressed in the barrel;

means for applying at least one of propulsion gas and propulsion air to said projectile to rapidly project said spherical projectile through the barrel; and a target spaced from said air gun or gas gun and comprising a surface of at least one of hook material and loop material opposite to the hook and loop material of said spherical projectile.

2. The combination gun, projectile therefor, and target of claim 1 wherein said target further comprises a layer of resilient material underlying said surface of at least one of hook material and loop material.

3. The combination gun, projectile therefor, and target of claim 1 further comprising means for spring-loading, in succession, a plurality of said projectiles.

4. The combination gun, projectile therefor, and target of claim 1 wherein said projectile is covered with hook material.

5. The combination gun, projectile therefor, and target of claim 1 wherein said projectile is covered with loop material.

6. The combination gun, projectile therefor, and target of claim 1 wherein said surface of said target comprises hook material.

7. The combination gun, projectile therefor, and target of claim 1 wherein said surface of said target comprises loop material.

8. A method for providing a combination gun, projectile therefor, and target comprising the steps of:

providing at least one of a compressed air gun and a compressed gas gun having a barrel;

providing at least one spherical projectile located in said gun and having an entire exterior surface comprising at least one of hook material and loop material;

said barrel being dimensioned to receive each of said at least one spherical projectile;

providing means located in a barrel of said gun for holding a circumferential peripheral portion of said spherical projectile in compression;

providing means for aligning said spherical projectile with said barrel through which said spherical projectile can pass only by being circumferentially compressed in the barrel;

providing means for applying at least one of propulsion gas and propulsion air to said projectile to rapidly project said spherical projectile through the barrel; and providing a target spaced from said air gun or gas gun and comprising a surface of at least one of hook material and loop material opposite to the hook and loop material of said spherical projectile.

9. The method of claim 8 wherein said target further comprises a layer of resilient material underlying said surface of at least one of hook material and loop material.

10. The method of claim 8 further comprising the step of providing means for spring-loading, in succession, a plurality of said projectiles.

11. The method of claim 8 wherein said projectile is covered with hook material.

12. The method of claim 8 wherein said projectile is covered with loop material.

13. The method of claim 8 wherein said surface of said target comprises hook material.

14. The method of claim 8 wherein said surface of said target comprises loop material.

* * * * *